US009687871B2

(12) United States Patent
Sato et al.

(10) Patent No.: US 9,687,871 B2
(45) Date of Patent: Jun. 27, 2017

(54) PROCESS FOR MANUFACTURING ELASTIC ROLLER, AND COATING APPARATUS

(71) Applicant: CANON KABUSHIKI KAISHA, Tokyo (JP)

(72) Inventors: Akinori Sato, Mishima (JP); Katsumi Otani, Tsukubamirai (JP); Yosuke Ata, Susono (JP); Masahiro Inami, Izunokuni (JP); Hironori Mori, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 32 days.

(21) Appl. No.: 14/856,867

(22) Filed: Sep. 17, 2015

(65) Prior Publication Data

US 2016/0089687 A1 Mar. 31, 2016

(30) Foreign Application Priority Data

Sep. 30, 2014 (JP) ..... 2014-200947

(51) Int. Cl.

| | |
|---|---|
| ***B05D 1/18*** | (2006.01) |
| ***B05C 5/02*** | (2006.01) |
| ***B05D 1/26*** | (2006.01) |
| ***B08B 1/04*** | (2006.01) |
| ***B08B 1/02*** | (2006.01) |

(Continued)

(52) U.S. Cl.

CPC ..... *B05C 5/0241* (2013.01); *B05C 11/021* (2013.01); *B05D 1/265* (2013.01); *B05D 7/146* (2013.01); *B08B 1/02* (2013.01); *B08B 1/04* (2013.01); *B05C 3/12* (2013.01);

(Continued)

(58) Field of Classification Search

CPC ..... B05D 1/18

See application file for complete search history.

(56) References Cited

U.S. PATENT DOCUMENTS

| | | | | |
|---|---|---|---|---|
| 6,276,018 | B1 * | 8/2001 | Leiman | B08B 9/045 15/104.095 |
| 8,871,307 | B2 | 10/2014 | Suzuki | |
| 2013/0142961 | A1 * | 6/2013 | Suzuki | B05D 1/18 427/430.1 |

FOREIGN PATENT DOCUMENTS

| | | | |
|---|---|---|---|
| JP | 2007-130589 A | | 5/2007 |
| JP | 2007130589 A | * | 5/2007 |
| JP | 2011-224451 A | | 11/2011 |

OTHER PUBLICATIONS

Machine Translation JP 2007130589 A.*

* cited by examiner

*Primary Examiner* — David Turocy

(74) *Attorney, Agent, or Firm* — Fitzpatrick, Cella, Harper & Scinto

(57) ABSTRACT

Provided that a process for manufacturing an elastic roller having a mandrel and a coating film. The process comprise a first step of forming a coating film on an outer peripheral surface of a first mandrel, and a second step of forming a coating film on an outer peripheral surface of a second mandrel. The process further comprises a cleaning step between the steps. The cleaning step comprising: making a cleaning member arranged coaxially with the central axis of a circular coating head, in a downstream side in a moving direction of the first mandrel with respect to the circular coating head, making the cleaning member relatively approach the circular coating head; bringing a surface to be cleaned into contact with the cleaning member; rotating the cleaning member while the surface comes in contact with (Continued)

the cleaning member; and inserting the cleaning member into the center hole.

3 Claims, 7 Drawing Sheets

(51) Int. Cl.

| | |
|---|---|
| ***B05D 7/14*** | (2006.01) |
| ***B05C 11/02*** | (2006.01) |
| *B05C 3/12* | (2006.01) |
| *B05C 9/08* | (2006.01) |

(52) U.S. Cl.
CPC ..... *B05C 9/08* (2013.01); *B05D 2202/25* (2013.01); *B05D 2254/02* (2013.01)

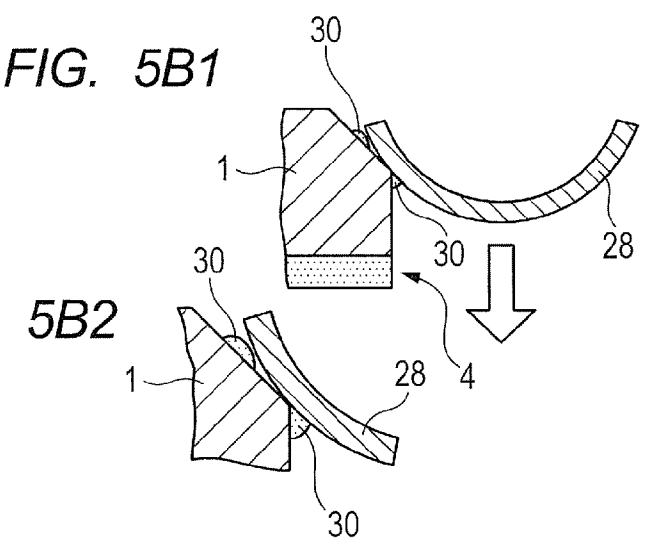
FIG. 5B1
FIG. 5B2
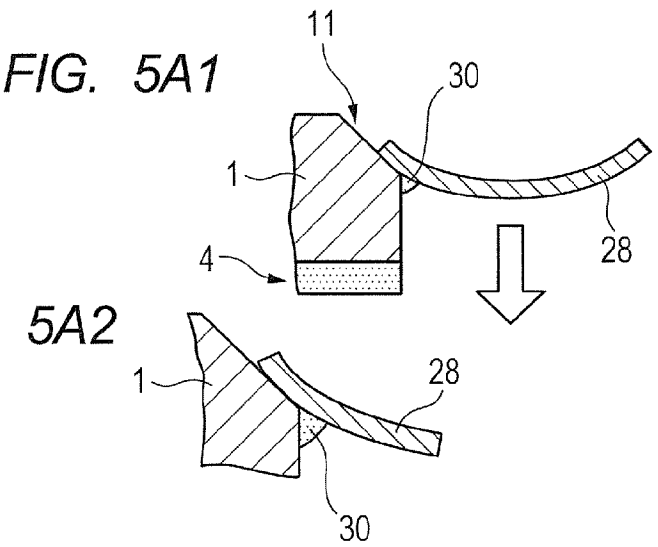
FIG. 5A1
FIG. 5A2

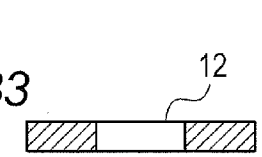
FIG. 7A1
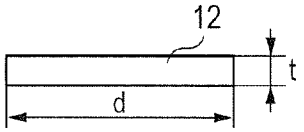
FIG. 7A2
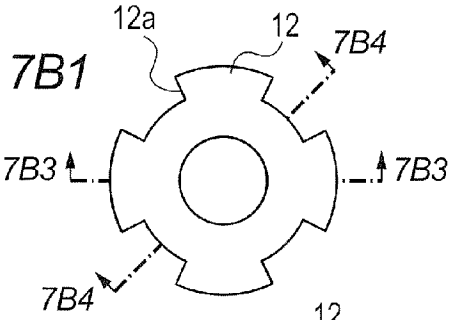
FIG. 7B1
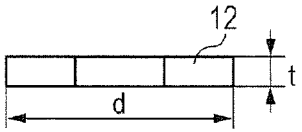
FIG. 7B2
FIG. 7B3
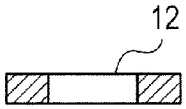
FIG. 7B4
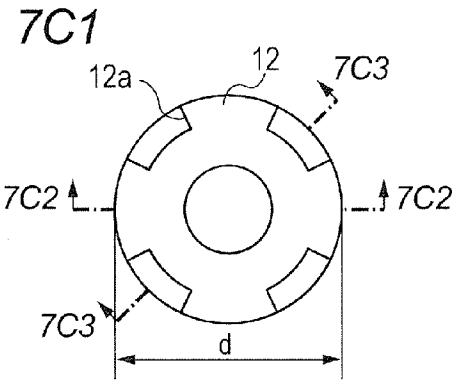
FIG. 7C1
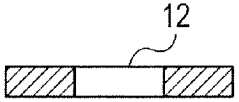
FIG. 7C2
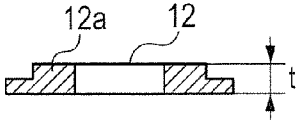
FIG. 7C3

FIG. 7D1
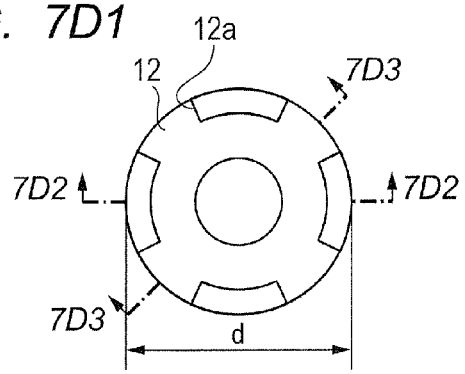
FIG. 7D2
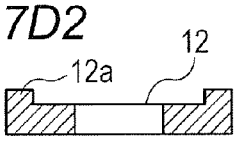
FIG. 7D3
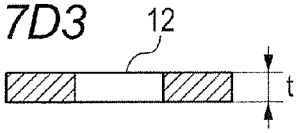
FIG. 7E1
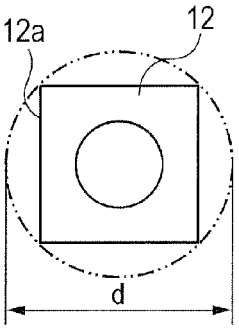
FIG. 7E2
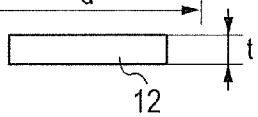
FIG. 7F1
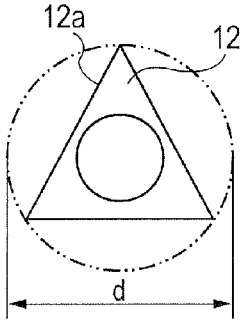
FIG. 7F2
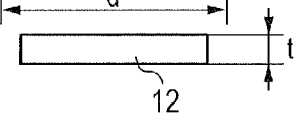
FIG. 8A
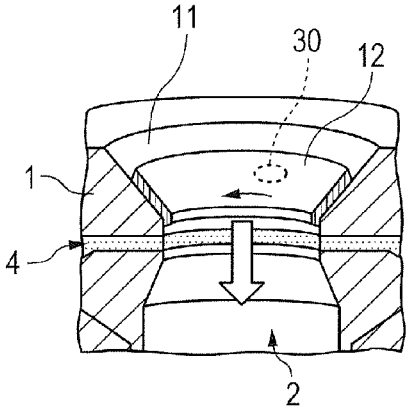
FIG. 8B
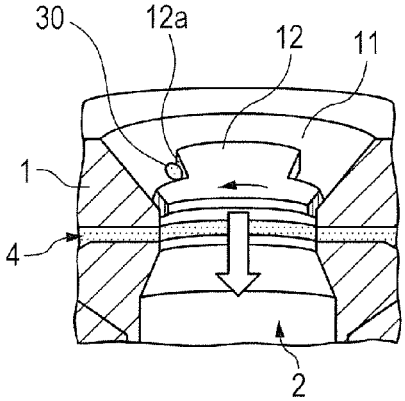

PROCESS FOR MANUFACTURING ELASTIC ROLLER, AND COATING APPARATUS

BACKGROUND OF THE INVENTION

Field of the Invention

The present invention relates to a process for manufacturing an elastic roller and a coating apparatus, and particularly relates to a process for manufacturing an elastic roller which is used for an electrophotographic image forming apparatus such as a copying machine and a laser printer and an electrophotographic process cartridge, with the use of a circular coating head, and a coating apparatus which is used in the process.

Description of the Related Art

As for a technology concerning the process of manufacturing the elastic roller by using the circular coating head, Japanese Patent Application Laid-Open No. 2011-224451 discloses a method for cleaning a circular slit, with the use of a disk member which is formed of an elastic material that has a larger outer diameter than a diameter of a center hole of the circular coating head and can be inserted into the center hole. This method can suppress a phenomenon that a coating material having remained in the inner part of the circular slit of the circular coating head leaks out in a period before the next ejection is started after the previous ejection.

The present invention is directed to providing a process for manufacturing an elastic roller in which a streak on the surface of a coating film is hardly generated, even in the case where a plurality of elastic rollers is manufactured.

In addition, the present invention is directed to providing a coating apparatus which can be used in manufacturing the elastic roller in which the streak on the surface of the coating film is hardly generated, even in the case where the plurality of elastic rollers is manufactured.

SUMMARY OF THE INVENTION

According to one aspect of the present invention, there is provided a process for manufacturing an elastic roller, the elastic roller having a mandrel and a coating film on an outer peripheral surface thereof, the process comprising:

a first step of forming a coating film of a coating material on an outer peripheral surface of a first mandrel by a circular coating head, and a second step of forming a coating film of the coating material on an outer peripheral surface of a second mandrel by the circular coating head, the circular coating head having a center hole, and a circular slit in an inner wall of the center hole, the circular slit being opened to a whole inner perimeter of the center hole, the first step including:

arranging the first mandrel approximately coaxially with a central axis of the circular coating head, and forming the coating film of the coating material on the outer peripheral surface of the first mandrel by relatively moving the circular coating head and the first mandrel while ejecting the coating material from the circular slit, and the second step including:

arranging the second mandrel approximately coaxially with a central axis of the circular coating head, and forming the coating film of the coating material on the outer peripheral surface of the second mandrel by relatively moving the circular coating head and the second mandrel while ejecting the coating material from the circular slit, wherein, the process further comprises a cleaning step between the first step and the second step, the cleaning step comprising making a cleaning member arranged approximately coaxially with the central axis of the circular coating head, in a downstream side in a moving direction of the first mandrel with respect to the circular coating head in the first step, the cleaning member being rotatable around the central axis of the circular coating head regarded as an approximate rotation center, having a rotation locus circle whose diameter is larger than a diameter of the center hole of the circular coating head, and being elastically deformable;

making the cleaning member relatively approach the circular coating head;

bringing a surface to be cleaned which faces to the cleaning member of the circular coating head into contact with the cleaning member;

rotating the cleaning member while the surface to be cleaned facing to the cleaning member contacts with the cleaning member; and inserting the cleaning member into the center hole.

According to another aspect of the present invention, there is provided a coating apparatus for manufacturing an elastic roller which has a mandrel and a coating film on an outer peripheral surface of the mandrel, comprising:

a circular coating head which has:

a center hole, and a circular slit in an inner wall of the center hole, the circular slit being opened to a whole inner perimeter of the center hole;

a first and a second holding shafts which hold the mandrel and arrange the mandrel inside of the center hole, and relatively move the mandrel with respect to the circular coating head in a longitudinal direction of the mandrel, when a coating material is ejected from the circular slit;

a rotary drive source which rotates one of the first and the second holding shafts at the same time when the first and the second holding shafts relatively move with respect to the circular coating head; and a cleaning member which is rotatably arranged concentrically with the center hole, has a rotation locus circle whose diameter is larger than a diameter of the center hole, and is elastically deformable, wherein the cleaning member is arranged to move with respect to the circular coating head so as to approach the center hole from a downstream side of the center hole in a direction in which the mandrel relatively moves with respect to the circular coating head, and is inserted into the inner part of the center hole, and rotates when the cleaning member comes in contact with the surface to be cleaned of the circular coating head.

Further features of the present invention will become apparent from the following description of exemplary embodiments with reference to the attached drawings.

BRIEF DESCRIPTION OF THE DRAWINGS

FIG. 5A1 is a schematic sectional view for describing a cleaning step by a conventional disk member.

FIG. 5A2 is an enlarged view of a ridge line portion illustrated in FIG. 5A1.

FIG. 5B1 is a schematic sectional view for describing the cleaning step by the conventional disk member, in the case where the disk member 28 has been moved to a more upstream side in a coating-film forming direction than a position in the case in FIG. 5A1.

FIG. 5B2 is an enlarged view of a ridge line portion illustrated in FIG. 5B1.

FIG. 7A1 is a plan view in one embodiment of a cleaning member which is used in the present invention.

FIG. 7A2 is a side view in one embodiment of the cleaning member which is used in the present invention.

FIG. 7B1 is a plan view of Modified Example 1 of the cleaning member which is used in the present invention.

FIG. 7B2 is a side view of Modified Example 1 of the cleaning member which is used in the present invention.

FIG. 7B3 is a sectional view in a lateral direction in FIG. 7B1.

FIG. 7B4 is a sectional view in an oblique direction in FIG. 7B1.

FIG. 7C1 is a plan view of Modified Example 2 of the cleaning member which is used in the present invention.

FIG. 7C2 is a sectional view in a lateral direction in FIG. 7C1.

FIG. 7C3 is a sectional view in an oblique direction in FIG. 7C1.

FIG. 7D1 is a plan view of Modified Example 3 of the cleaning member which is used in the present invention.

FIG. 7D2 is a sectional view in a lateral direction in FIG. 7D1.

FIG. 7D3 is a sectional view in an oblique direction in FIG. 7D1.

FIG. 7E1 is a plan view of Modified Example 4 of the cleaning member which is used in the present invention.

FIG. 7E2 is a side view of Modified Example 4 of the cleaning member which is used in the present invention.

FIG. 7F1 is a plan view of Modified Example 5 of the cleaning member which is used in the present invention.

FIG. 7F2 is a side view of Modified Example 5 of the cleaning member which is used in the present invention.

FIG. 8A is a partially cut out perspective view for describing the cleaning step by the cleaning member illustrated in FIGS. 7A1 and 7A2, which does not have a ridge portion 12*a*.

FIG. 8B is a partially cut out perspective view for describing the cleaning step by the cleaning member illustrated in FIG. 7B1 and the like, which has the ridge portion 12*a*.

DESCRIPTION OF THE EMBODIMENTS

Figure 1:
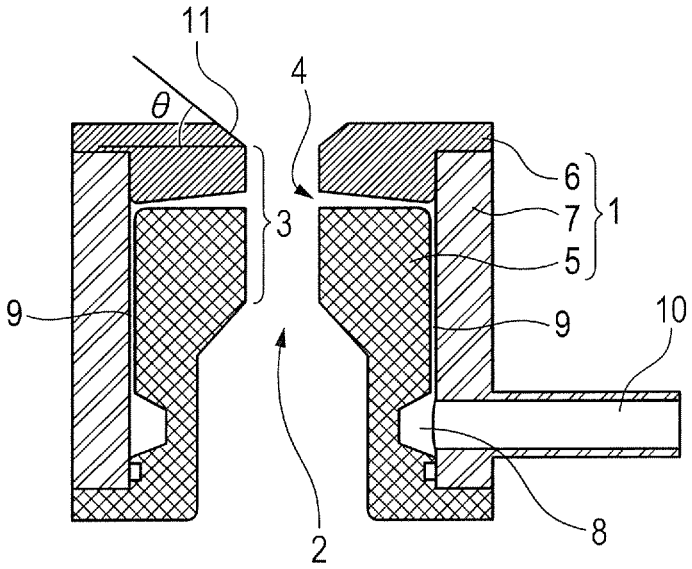
FIG. 1 is a sectional view of one example of a circular coating head which is used in the present invention.

Preferred embodiments of the present invention will now be described in detail in accordance with the accompanying drawings.

In a method for manufacturing an elastic roller disclosed in Japanese Patent Application Laid-Open No. 2011-224451, a circular slit is cleaned with the use of a disk member. This method suppresses leakage of a coating material in the circular slit of the circular coating head, and also can simultaneously clean an inner peripheral surface of a center hole of the circular coating head.

However, according to the investigation of the present inventors, when the present inventors have manufactured a plurality of elastic rollers by using a method according to the invention described in Japanese Patent Application Laid-Open No. 2011-224451, it has been found that a streak of a convex shape, which extends in a longitudinal direction, is occasionally formed on the surface of the coating film on each of the elastic rollers after the second elastic roller. This tendency has been particularly remarkably recognized when a coating speed has been increased.

The present inventors have made an investigation on the reason why the above described problem occurs in the method for manufacturing the elastic roller according to Japanese Patent Application Laid-Open No. 2011-224451. As a result, there has been the case where the coating material remains on the inner peripheral surface of the center hole of the circular coating head which has been cleaned with the use of the disk, and has also been the case where the coating material adheres also to a surface in a downstream side of the circular coating head in a coating-film forming direction (hereinafter referred to as "downstream face in coating-film forming direction").

In other words, in the method of Japanese Patent Application Laid-Open No. 2011-224451, the inner peripheral surface of the center hole of the circular coating head can be cleaned, but the coating material occasionally remains on the downstream face in the coating-film forming direction. The present inventors have found out that when the next elastic roller is manufactured in the state in which the coating material remains on the downstream face in the coating-film forming direction, the streak of a convex shape, which extends in a longitudinal direction, is occasionally formed on the surface of the elastic roller.

When such an elastic roller that the streak of the convex shape is formed thereon is used as a developing roller, for instance, an image failure may output due to the streak of the convex shape occasionally results in appearing on the image.

Furthermore, the present inventors have found out that the above described problem which occasionally occurs in the method for manufacturing the elastic roller according to Japanese Patent Application Laid-Open No. 2011-224451 can be solved by the following process.

In other words, the present invention relates to a process for manufacturing a plurality of elastic rollers each having a coating film on an outer peripheral surface of a mandrel. That is, the present invention relates to a process for manufacturing an elastic roller, the elastic roller having a mandrel and a coating film on an outer peripheral surface thereof.

The process comprises:

a first step of forming a coating film of a coating material on an outer peripheral surface of a first mandrel by a circular coating head, and a second step of forming a coating film of the coating material on an outer peripheral surface of a second mandrel by the circular coating head. The circular coating head has a center hole, and a circular slit in an inner wall of the center hole, the circular slit being opened to a whole inner perimeter of the center hole.

The first step includes:

arranging the first mandrel approximately coaxially with a central axis of the circular coating head, and forming the coating film of the coating material on the outer peripheral surface of the first mandrel by relatively moving the circular coating head and the first mandrel while ejecting the coating material from the circular slit.

The second step includes:

arranging the second mandrel approximately coaxially with a central axis of the circular coating head, and forming the coating film of the coating material on the outer peripheral surface of the second mandrel by relatively moving the circular coating head and the second mandrel while ejecting the coating material from the circular slit.

The process further comprises a cleaning step between the first step and the second step, and the cleaning step comprises making a cleaning member arranged approximately coaxially with the central axis of the circular coating head, in a downstream side in a moving direction of the first mandrel with respect to the circular coating head in the first step, making the cleaning member relatively approach the circular coating head;

bringing a surface to be cleaned which faces to the cleaning member of the circular coating head into contact with the cleaning member;

rotating the cleaning member while the surface to be cleaned facing to the cleaning member comes in contact with the cleaning member; and inserting the cleaning member into the center hole.

The cleaning member is rotatable around the central axis of the circular coating head regarded as an approximate rotation center, has a rotation locus circle whose diameter is larger than a diameter of the center hole of the circular coating head, and is elastically deformable.

(Phenomenon that Coating Material Adheres to Downstream Face in Coating-Film Forming Direction)

Figure 3A:
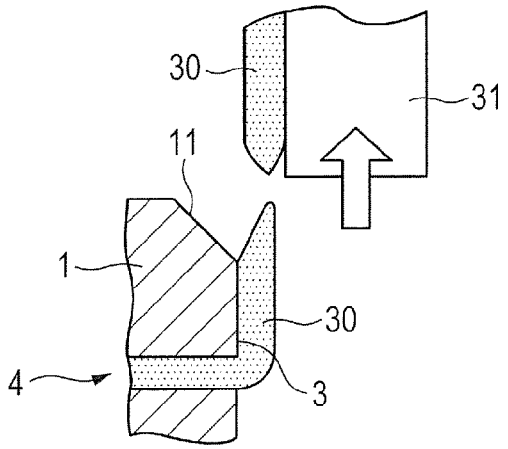
FIG. 3A is a schematic sectional view illustrating a state after coating, in which a coating material adheres to the circular coating head.

The present inventors have focused on a phenomenon that the coating material adheres to a downstream face 11 in a coating-film forming direction, in a step of coating an outer peripheral surface of a mandrel with a coating material with the use of a circular coating head 1, and have made an investigation on the reason. As illustrated in FIG. 3A, a coated mandrel 31 is separated from the circular coating head 1 in a state in which coating of a coating material 30 onto a mandrel 31 has ended, and ejection of the coating material 30 from a circular slit 4 has been stopped. Then, the coating material 30 which is positioned between an inner wall 3 of a center hole 2 and the outer peripheral surface of the mandrel 31 is stretched to both directions of the circular slit 4 and the mandrel 31.

Figure 3B:
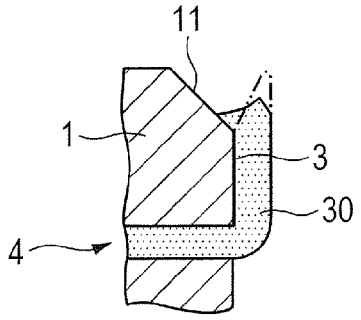
FIG. 3B is a schematic sectional view illustrating a state after the coating in a later time than that in FIG. 3A, in which the coating material adheres to the circular coating head.

The coating material 30 adheres to peripheries of the circular slit 4 and the center hole 2. At this time, the stretched coating material 30 rises beyond the inner wall 3 of the center hole 2, toward the downstream side in the coating-film forming direction. After that, as illustrated in FIG. 3B, the risen coating material 30 falls down, adheres onto a downstream face 11 in a coating-film forming direction, and shifts to a state shown by a solid line from a state shown by a chain double-dashed line. It has been found that there is the case as in the above.

(Influence of Coating Material Having Adhered to Downstream Face in Coating-Film Forming Direction on Coating Step of Next Time)

Subsequently, the present inventors have focused on a fact that when a plurality of elastic rollers is manufactured, and when the next elastic roller has been manufactured in the state in which the coating material 30 adheres to the downstream face 11 in the coating-film forming direction as described above, a streak of a convex shape may occur on an elastic roller which has been manufactured later. In order to investigate the reason, the present inventors have observed states of the circular coating head 1 and the coating material 30 during coating, in detail.

Figure 4A:
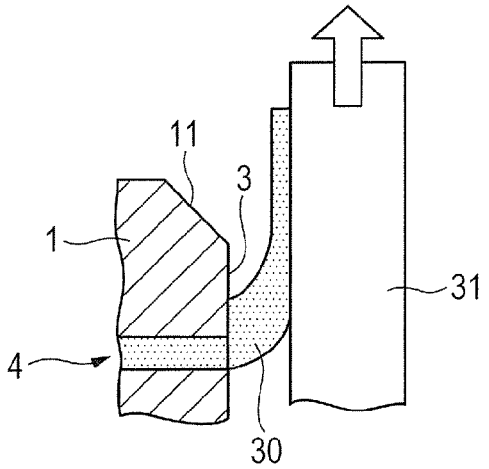
FIG. 4A is a schematic sectional view illustrating a state of a surface of the coating material during coating, in the case where a moving speed of a mandrel 31 is slow.
Figure 4B:
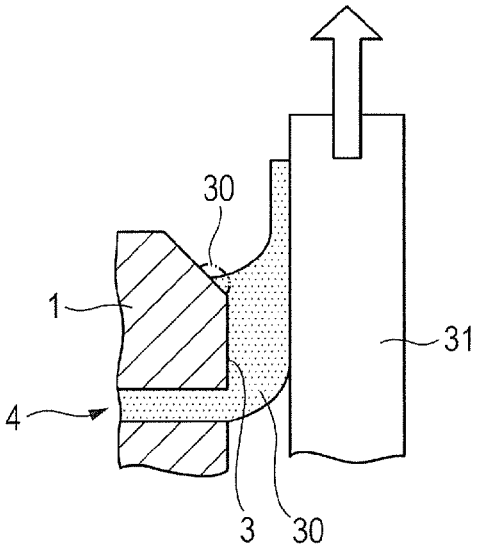
FIG. 4B is a schematic sectional view illustrating a state of the surface of the coating material during coating, in the case where the moving speed of the mandrel 31 is fast.

FIGS. 4A and 4B illustrate schematic views of the circular coating head 1 and the coating material 30 during the coating. When a coating speed, specifically, a moving speed of the mandrel 31 is slow, as illustrated in FIG. 4A, the coating material 30 which has been ejected from the circular slit 4 and is now positioned between the inner wall 3 of the center hole 2 and the outer peripheral surface of the mandrel 31 is not raised up to such a high position. Accordingly, the position of the surface (gas-liquid interface) of the coating material 30 stays on the inner wall 3 of the center hole 2.

On the other hand, when the coating speed (moving speed of mandrel 31) is increased, as illustrated in FIG. 4B, the coating material 30 which is positioned between the inner wall 3 of the center hole 2 and the outer peripheral surface of the mandrel 31 is pulled by the outer peripheral surface of the mandrel 31 which rises at a high speed and is raised up to a higher position. As a result, the position of the surface of the coating material 30 occasionally reaches the downstream face 11 in the coating-film forming direction, which has a bowl shape, beyond the inner wall 3 of the center hole 2. It occasionally occurs that the coating material 30 which has adhered to the downstream face 11 in the coating-film forming direction when the previous elastic roller has been manufactured (shown by chain double-dashed line in FIG. 4B) and the coating material 30 which has been ejected when the next elastic roller is manufactured (in high-speed coating step in particular) and then has reached the downstream face 11 in the coating-film forming direction come in contact with and rub against each other. It is considered that in this case, the streak of the convex shape is formed on the surface of the elastic layer of the elastic roller which has been subsequently manufactured.

Then, it is desired that the streak of the convex shape is not formed on the elastic roller even when the elastic rollers are continuously manufactured (particularly when coating speed is fast). In order to satisfy the requirement, it is considered to be enough to sufficiently clean, the downstream face 11 in the coating-film forming direction so that the coating material 30 does not remain on the downstream face 11 in the coating-film forming direction, in a period after the coating of the elastic roller has ended and before the coating of the next elastic roller starts. As one example of a cleaning process for removing the coating material which has adhered to the downstream face 11 in the coating-film forming direction, there is a process for cleaning the downstream face 11 in the coating-film forming direction with the use of a disk member which has a larger outer diameter than a diameter of the center hole 2 of the circular coating head 1 and can be elastically deformed. The present inventors have observed the state of the circular coating head 1 and the coating material 30 at this time, in detail.

Figure 2:
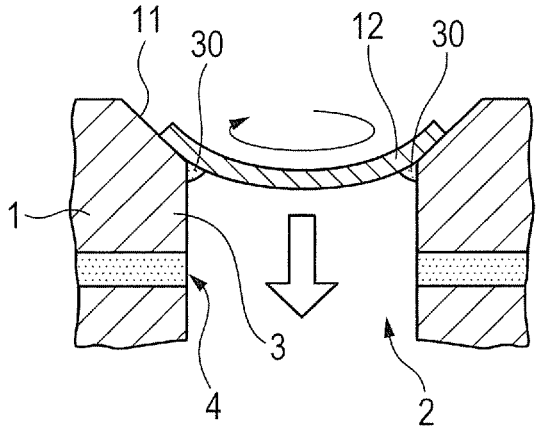
FIG. 2 is a schematic sectional view for describing a cleaning step in a process for manufacturing an elastic roller of the present invention.

As illustrated in FIGS. 5A1 and 5A2, the disk member 28 having the above described structure is made to approach the circular coating head 1 from the downstream side in the coating-film forming direction, and is pressed against the downstream face 11 in the coating-film forming direction while being elastically deformed. When the disk member 28 comes in contact with the coating material 30 on the downstream face 11 in the coating-film forming direction, the coating material 30 is wiped off by the disk member 28. However, when the disk member 28 is moved further to the upstream side from the downstream side in the coating-film forming direction, the disk member 28 is elastically deformed to a larger degree, while a ridge line which connects the downstream face 11 in the coating-film forming direction and the center hole 2 works as a supporting point, as illustrated in FIGS. 5B1 and 5B2.

As a result, the end of the disk member 28 leaves the downstream face 11 in the coating-film forming direction. Accordingly, there is a possibility that the disk member 28 becomes not to rub the coating material 30 which has adhered to the downstream face 11 in the coating-film forming direction. Thus, a time period is extremely short during which the disk member 28 can rub the coating material 30 that has adhered to the downstream face 11 in the coating-film forming direction, and accordingly it can occur that the coating material 30 which has adhered to the downstream face 11 in the coating-film forming direction cannot be sufficiently cleaned. As a result, in spite of having been cleaned, the coating material 30 results in keeping adhering to and remaining on the downstream face 11 in the coating-film forming direction. When the subsequent elastic rollers have been manufactured (in high-speed coating step in particular), the coating material 30 which is positioned between the inner wall 3 of the center hole 2 and the outer peripheral surface of the mandrel 31 reaches the downstream face 11 in the coating-film forming direction, as illustrated in FIG. 4B; and comes in contact with and is rubbed with the remaining coating material 30. Then, the streak of the convex shape is occasionally formed on the surface of the elastic layer of the elastic roller which has been manufactured later. When the elastic roller on which the streak of the convex shape has been formed is used as a developing roller of an electrophotographic image forming apparatus, for instance, an image failure occurs due to the streak of the convex shape. At this time, the degree of the image failure depends on the height of the streak. Accordingly, the height of the streak of the convex shape must be controlled to at least less than 15 μm, and can be controlled to less than 10 μm.

Based on these investigation results, in the present invention, a cleaning member 12 is employed which can be elastically deformed, is substantially concentric with the circular coating head 1, and can rotate around a rotary shaft which substantially coincides with the central axis of the circular coating head 1 and is regarded as the center. This cleaning member 12 is pressed against the downstream face 11 in the coating-film forming direction while being rotated, and is moved from the downstream side to the upstream side in the coating-film forming direction. When the cleaning member 12 is pressed against the downstream face 11 in the coating-film forming direction while being rotated as illustrated in FIG. 2, the cleaning member 12 and the coating material 30 which has adhered to the downstream face 11 in the coating-film forming direction thereby rub each other more strongly. Accordingly, even though the time period is short during which the cleaning member 12 rubs the coating material 30 that has adhered to the downstream face 11 in the coating-film forming direction, the coating material 30 can be efficiently scraped off. When this cleaning step is performed, the elastic roller which does not have the streak having the convex shape can be thereby manufactured.

Embodiments of the present invention will now be described below.

[Outline of One Embodiment of Present Invention]

(Outline of Structure of Circular Coating Head)

FIG. 1 illustrates one embodiment of the circular coating head 1 which is used in the process for manufacturing the elastic roller of the present invention. This circular coating head 1 has an approximately cylindrical shape which has the center hole 2 therein, and has the circular slit 4 formed therein which is a portion notched out from the inner wall 3 toward the outside of the center hole 2. In other words, the circular coating head 1 of the approximately cylindrical shape includes: a first circular member 5 and a second circular member 6 which are divided by the circular slit 4 as a border; and a holding member 7 which holds the circular members. On the outer peripheral surface of the first circular member 5, a groove 8 for supplying a material therethrough is provided. In addition, a gap 9 exists in between the outer peripheral surface of the first circular member 5 and the inner peripheral surface of the holding member 7, and this gap 9 is connected to the groove 8 and the outer peripheral portion of the circular slit 4. The inner peripheral portion of the circular slit 4 becomes an opening which is opened to the inner wall 3 of the center hole 2. A coating-material supply section 10 is provided which penetrates the holding member 7 and communicates with the groove 8.

The second circular member 6 of the circular coating head 1 of the present embodiment has an inclined surface of a bowl shape, which becomes gradually lower from the outer peripheral portion toward the center hole 2, as shown as an upper surface 11 in FIG. 1, in a portion in the vicinity of the center hole 2. When the mandrel is coated with the coating material, the mandrel usually moves upward from the lower part in the inner part of the center hole 2 in FIG. 1, and accordingly this inclined surface is the surface 11 in the downstream side in the coating-film forming direction (downstream face in coating-film forming direction). In the present embodiment, the downstream face 11 in the coating-film forming direction is mainly a surface to be cleaned, and the cleaning member 12 (see FIG. 2) is used for cleaning the downstream face 11 in the coating-film forming direction. The cleaning member 12 illustrated in FIG. 2 can be elastically deformed, shall be positioned so as to be substantially concentric with the center hole 2 when cleaning the face, and can rotate around the central axis of the circular coating head 1 (center hole 2), which is regarded as the approximate center. As for one example, the cleaning member 12 has a circular shape, and has a larger diameter at least than that of the center hole 2.

(Outline of Coating Step and Cleaning Step)

In the present embodiment, an elastic layer material (coating material) which has been supplied from the outside of the circular coating head 1 to the coating-material supply section 10 is lead to the circular slit 4 from the groove 8 through the gap 9. This coating material is further ejected from the opening which is the inner peripheral portion of the circular slit 4, toward the inside of the center hole 2. Accordingly, the coating material is ejected from the opening of the circular slit 4 as described above, while the mandrel is moved relatively to the circular coating head 1 along the longitudinal direction of the center hole 2, in the state of being inserted into the inner part of the center hole 2, and thereby the outer peripheral surface of the mandrel can be coated with the coating material.

After the coating for the mandrel with the coating material has ended, as illustrated in FIG. 2, the cleaning member 12 is made to approach the circular coating head 1 from the downstream side (upper part in FIGS. 1 and 2) in the coating-film forming direction, and is pressed against the downstream face 11 in the coating-film forming direction while being elastically deformed.

The cleaning member 12 is rotated around the rotary shaft which substantially coincides with the central axis of the center hole 2 of the circular coating head 1 and is regarded as the center, right before the cleaning member 12 comes in contact with the downstream face 11 in the coating-film forming direction. Thereby, the cleaning member 12 is pressed against the downstream face 11 in the coating-film forming direction while being rotated. When the cleaning member 12 has been moved further to the upstream side from the downstream side in the coating-film forming direction (from upper part to lower part in FIGS. 1 and 2), the cleaning member 12 moves along the downstream face 11 in the coating-film forming direction of the bowl shape while being elastically deformed.

The cleaning member 12 further elastically deforms, and enters into the inner part of the center hole 2. As a result, the coating material 30 which has adhered to the downstream face 11 in the coating-film forming direction is wiped off by the cleaning member 12, and the downstream face 11 in the coating-film forming direction becomes clean. Thus, the cleaning member 12 is rotated, and particularly thereby, the cleaning member 12 and the coating material which has adhered to the downstream face 11 in the coating-film forming direction rub each other more strongly. Accordingly, even when the time period is short during which the coating material is rubbed, the coating material which has adhered to the downstream face 11 in the coating-film forming direction can be efficiently scraped off.

In the case where a plurality of mandrels is continuously coated with the coating material and this cleaning step is interposed between the coating steps, the coating material 30 is efficiently removed which has adhered to the downstream face 11 in the coating-film forming direction in the previous coating step, and then the next coating step can be performed. Accordingly, an adequate elastic roller can be manufactured which does not have the streak of the convex shape thereon.

[Detail of One Embodiment of Present Invention]

The present invention will be described in more detail below.

(Detail of Structure of Coating Apparatus)

Figure 6:
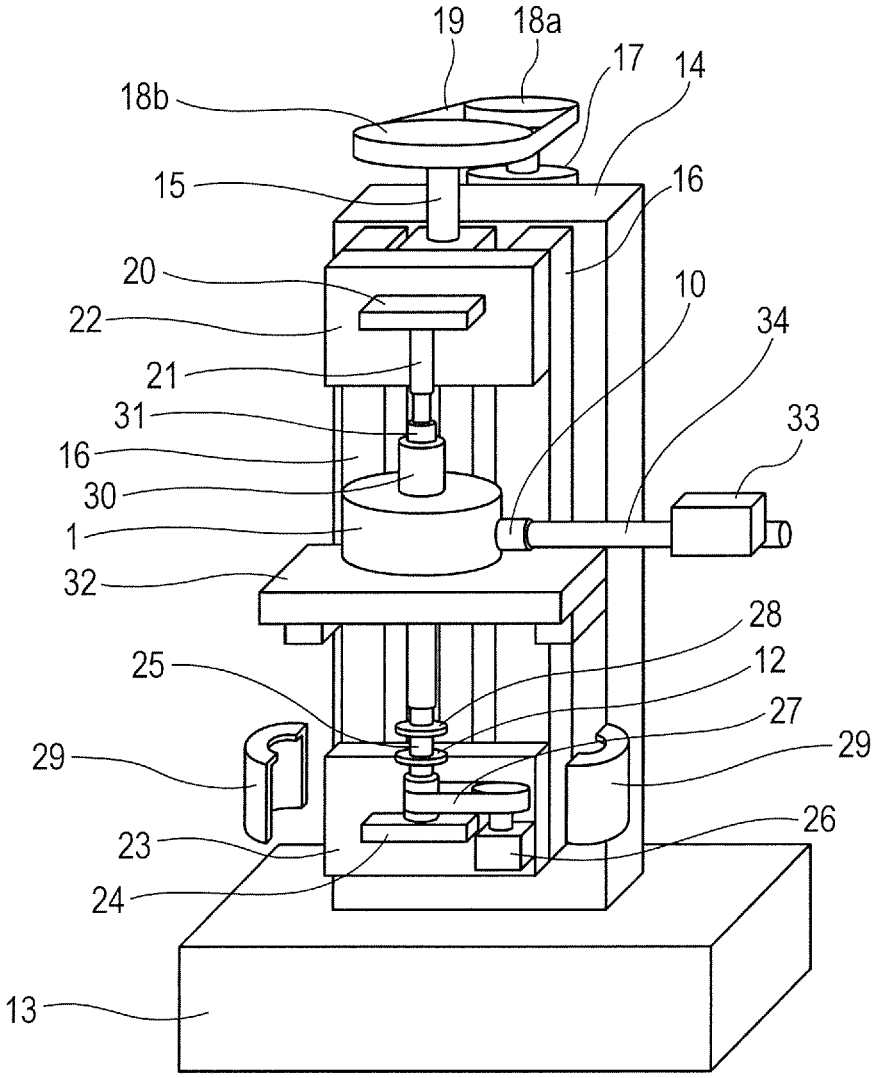
FIG. 6 is a perspective view of one example of a coating apparatus of the present invention, which includes the circular coating head illustrated in FIG. 1.

FIG. 6 illustrates a coating apparatus which incorporates the circular coating head 1 (see FIG. 1) of the present embodiment. In this coating apparatus, a precision ball screw 15 is installed on a column 14 which is installed approximately vertically on a pedestal 13. In both sides of the precision ball screw 15, two linear guides 16 which are substantially parallel to the precision ball screw 15 are installed on the column 14. To these linear guides 16 and the precision ball screw 15, an upper LM (Linear motion) guide 22 and a lower LM guide 23 are connected. A servomotor 17 and a pulley 18*a* are installed on a face of the column 14 in an opposite side to the face on which the linear guide 16 and the precision ball screw 15 are installed. A belt 19 is looped over the pulley 18*a* and a pulley 18*b* which is connected to the precision ball screw 15, and the pulleys 18*a* and 18*b* are structured so as to be interlocked with each other through the belt 19. Accordingly, when the servomotor 17 operates, the precision ball screw 15 rotates through the pulleys 18*a* and 18*b* and the belt 19, and thereby the LM guides 22 and 23 move up and down. In a supporting section 32 of the column 14, the circular coating head 1 is installed which ejects the uncured coating material 30 to the outer peripheral surface of the cylindrical mandrel 31. A bracket 20 is installed on the LM guide 22, and on this bracket 20, an upper holding shaft (a first holding shaft) 21 is installed which holds the cylindrical mandrel 31 that is an object to be coated.

A bracket 24 which faces the bracket 20 is installed on the lower LM guide 23, and a lower holding shaft (a second holding shaft) 25 which faces the upper holding shaft 21 and holds the mandrel 31 is rotatably installed on this bracket 24. In addition, a rotary drive source 26 is installed on the bracket, and a rotary shaft of this rotary drive source 26 and the lower holding shaft 25 are connected to each other by a rotation transmitting belt 27. Accordingly, when the rotary drive source 26 operates, the lower holding shaft 25 rotates through the rotation transmitting belt 27. The lower holding shaft 25 is structured so as to smoothly rotate without causing shaft vibration when rotating. In addition, the cleaning member 12 and the disk member 28 are attached to the lower holding shaft 25. The cleaning member 12 can elastically deform as described above, is substantially coaxial with the upper holding shaft 21 and the lower holding shaft 25, and rotates integrally with the lower holding shaft 25. The disk member 28 may be substantially similar to the cleaning member 12.

A collection container 29 for efficiently collecting the coating material which is blown off by a centrifugal force that is generated at the time of high-speed rotation is provided in the outside of the LM guide 23. The collection container 29 is formed of two members which are openable and closable by an unillustrated driving mechanism, and the collection container 29 waits in a state of being opened when being not used, so as not to interfere with an attaching/detaching operation for the mandrel 31 and a coating operation for the mandrel 31. Then, when the cleaning member 12 rotates at high speed and the coating material 30 is blown off, the collection container 29 is closed so as to collect the blown off coating material 30 in the inside of the collection container 29. In addition, the lower face of the collection container 29 has an opened shape so as not to interfere with the lower holding shaft 25 and the cleaning member 12 when the collection container 29 has been closed. The inner surface of the collection container 29 can be coated with a fluorine resin or the like, and can be subjected to a releasing treatment for the coating material 30.

On the supporting section 32 of the column 14, the circular coating head 1 is immovably installed which ejects the uncured coating material 30 to the outer peripheral surface of the mandrel 31. The circular coating head 1 in the present embodiment has the above described structure which is illustrated in FIG. 1, and is arranged so that the center of the center hole 2 substantially coincides with the centers of the lower holding shaft 25 and the upper holding shaft 21. The width of the circular slit 4 of the circular coating head 1 is usually 0.5 mm or more and 2.0 mm or less, and the height of the inner wall 3 of the center hole 2 is usually 0.5 mm or more and 5.0 mm or less. The downstream face 11 in the coating-film forming direction has such a taper shape (bowl shape) that the diameter thereof decreases toward the center hole 2. In addition, an unillustrated material supply pump is connected to a coating-material supply port of the circular coating head 1 through a material supply valve 33, a pipe 34 and the coating-material supply section 10.

Incidentally, this coating apparatus is provided vertically on a pedestal 13.

(Detail of Each Step of Manufacturing Process)

The process for manufacturing the elastic roller of the present invention by using the above described coating apparatus will be described below.

Firstly, the cylindrical mandrel which is an object to be coated is fixed in a way of being sandwiched between the upper holding shaft 21 and the lower holding shaft 25 of the coating apparatus. Then, the precision ball screw 15 is rotated by the servomotor 17 through the pulleys 18*a* and 18*b* and the belt 19 to move the LM guides 22 and 23 in vertical directions and set the mandrel 31 at a coating starting position. Because the center of the center hole 2 of the circular coating head 1 substantially coincides with the centers of the lower holding shaft 25 and the upper holding shaft 21, a gap having equal sizes over the whole inner perimeter is formed between the inner wall 3 of the center hole 2 and the outer peripheral surface of the mandrel 31 which has a smaller diameter than that of the inner wall 3. The LM guides 22 and 23 are moved up, thereby the mandrel 31 is moved up, and simultaneously the coating material 30 which has been supplied to the coating-material supply section 10 and the groove 8 through the material supply valve 33 and the pipe 34 is ejected to the inside from the circular slit 4 through the gap 9, and is made to adhere to the outer peripheral surface of the mandrel. Thereby, the coating film is formed on the outer peripheral surface over the whole length of the mandrel 31.

After the coating for the mandrel 31 with the coating material 30 has ended, the cleaning step is performed before the coating for the next mandrel 31 with the coating material 30 starts. Specifically, when the outer peripheral surface of the mandrel 31 is coated with the coating material 30, the LM guides 22 and 23 are moved up until the cleaning member 12 and the disk member 28 which are attached on the lower holding shaft 25 are positioned above the circular coating head 1. After the mandrel 31 of which the outer peripheral surface has been coated with the coating material 30 has been removed from the coating apparatus, the LM guides 22 and 23 are moved down while the lower holding shaft 25 is rotated. Thereby, the cleaning member 12 abuts on the circular coating head 1 while rotating. At this time, as illustrated in FIG. 2, the cleaning member 12 is pressed against the downstream face 11 in the coating-film forming direction while being elastically deformed, and wipes off the coating material 30 which has adhered to the downstream face 11 in the coating-film forming direction. Because the cleaning member 12 strongly rubs the coating material 30 on the downstream face 11 in the coating-film forming direction, due to the rotation of the cleaning member 12, even if the time period is short during which the coating material 30 is rubbed, the cleaning member 12 can efficiently scrape off the coating material 30. The cleaning member 12 which has wiped off the coating material 30 on the downstream face 11 in the coating-film forming direction further moves down while being shrunk, and enters into the inner part of the center hole 2.

In the present embodiment, when the LM guide 23 is positioned in the uppermost part, the cleaning member 12 and the disk member 28 are positioned above the inner wall 3 of the center hole 2 of the circular coating head 1. When the LM guide 23 is positioned in the lowermost part, the cleaning member 12 and the disk member 28 are positioned below the circular coating head 1. Accordingly, the lower holding shaft 25 is rotated by the rotary drive source 26, while the LM guide 23 moves the lower holding shaft 25 down from above. Thereby, the cleaning member 12 rotates around a rotary shaft which is substantially coaxial with the central axis of the center hole 2 and is regarded as the center, while coming in contact with the circular coating head 1 from the downstream side in the coating-film forming direction, and cleans the downstream face 11 of the circular coating head 1 in the coating-film forming direction.

In the present embodiment, after the coating step for the elastic roller, the coating material 30 on the downstream face 11 in the coating-film forming direction is wiped off by the rotating cleaning member 12 in the above way. Because of this, even if the coating material which has been ejected from the circular slit 4 has reached the downstream face 11 in the coating-film forming direction, similarly to the state illustrated in FIG. 4B, in the coating step (in high-speed coating step in particular) for the subsequent elastic rollers, the coating material does not come in contact with and rub against the coating material 30, on the downstream face 11 in the coating-film forming direction. Accordingly, the streak of the convex shape can be reduced, which is formed on the surface of the elastic layer of the elastic roller.

The coating material 30 which has been blown off by a centrifugal force due to the high-speed rotation of the lower holding shaft 25, after having been collected by the cleaning member 12, is collected in the inner part of the closed collection container 29, and does not make other members dirty.

(Specific Dimension, Material and Modified Example of Each Section)

The coating apparatus of the present invention, which has been described above, will be supplemented below.

A mechanism for cleaning the circular coating head 1, which is included in the coating apparatus of the present invention, may be capable of being arranged so that the center of the cleaning member 12 substantially coincides with the center of the center hole 2 of the circular coating head 1, and may be capable of rotating the cleaning member 12 substantially coaxially with the center hole 2 of the circular coating head 1. Thereby, the cleaning member 12 abuts on a surface to be cleaned (downstream face 11 in the coating-film forming direction) of the circular coating head 1 while rotating, and can remove the adhering coating material 30.

In the previously described embodiment, the cleaning member 12 is attached to the lower holding shaft 25, and the cleaning member 12 is arranged so as to be coaxial with the lower holding shaft 25. Specifically, the lower holding shaft 25 and the cleaning member 12 are adjusted so as to come to positions of being approximately coaxial with the central axis of the circular coating head 1, by an unillustrated position adjusting mechanism. The lower holding shaft 25 is structured so as to be connected to and be rotated by the rotary shaft of the rotary drive source 26. However, it is acceptable to structure the upper holding shaft 21 so as to be rotatable by the rotary drive source and to attach the cleaning member 12 to the upper holding shaft 21; or it is also acceptable to additionally provide a shaft having a moving unit and a rotating unit and to attach the cleaning member 12 to the shaft.

The cleaning mechanism more desirably has a unit (disk member 28, for instance) for cleaning the inner wall 3 of the center hole 2 of the circular coating head 1 and the periphery of the circular slit 4, in addition to the cleaning member 12 for cleaning the downstream face 11 in the coating-film forming direction, such as the previously described embodiment. In the case of the above described embodiment, the LM guide 23 is moved to move the lower holding shaft 25 down and make the disk member 28 pass through the center hole 2 of the circular coating head 1. Thereby, the inner wall 3 of the center hole 2 of the circular coating head 1 is cleaned. However, the unit for cleaning the inner wall 3 of the center hole 2 is arbitrary, and the disk member 28 may be structured so as to be attached to the upper holding shaft 21.

In addition, the upper holding shaft 21 may also be structured so as to be movable in an approximately vertical direction by an unillustrated cylinder, move downward when the mandrel is sandwiched, and move upward when the mandrel is taken out from the coating apparatus.

Next, the cleaning member 12 of the present invention will be described below with reference to FIGS. 7A1 to 7F2.

The cleaning member 12 of the present invention may be circular as illustrated in FIGS. 7A1 and 7A2, but further can have a ridge portion 12*a* having an edge shape that extends in a direction which intersects with a rotation direction, specifically, which intersects with a tangent line of a rotation locus circle of the cleaning member 12. For instance, in Modified Example 1 illustrated in FIGS. 7B1 to 7B4, the cleaning member 12 is formed to have a cut out shape, and has the ridge portion 12*a* provided therein.

In addition, in Modified Examples 2 and 3 illustrated in FIGS. 7C1 to 7C3, and FIGS. 7D1 to 7D3, the cleaning member 12 has a step, and a portion of the step becomes the ridge portion 12*a*.

In Modified Examples 4 and 5 illustrated in FIGS. 7E1 to 7E2 and FIGS. 7F1 to 7F2, the planar shape of the cleaning member 12 is not circular but is polygonal such as a quadrangle (Modified Example 4) and a triangle (Modified Example 5), for instance, and accordingly the sides of the polygon form the ridge portion 12*a*. Incidentally, "d" in FIGS. 7E1 and 7F1 shows the rotation locus circle of the cleaning member 12.

In addition, FIGS. 7A1, 7B1, 7C1, 7D1, 7E1 and 7F1 are plan views of the cleaning member 12; and FIGS. 7A2, 7B2, 7E2 and 7F2 are side views thereof. Furthermore, FIGS. 7B3, 7C2 and 7D2 are sectional views in a lateral direction of FIGS. 7B1, 7C1 and 7D1, respectively; and FIGS. 7B4, 7C3 and 7D3 are sectional views in an oblique direction of FIGS. 7B1, 7C1 and 7D1, respectively.

According to the cleaning member 12 illustrated in FIGS. 7A1 and 7A2, the coating material 30 is scraped off by the cleaning member 12 which planarly overlaps on the downstream face 11 in the coating-film forming direction to which the coating material 30 has adhered, as schematically illustrated in FIG. 8A.

In contrast to this, according to the cleaning members 12 each having the ridge portion 12*a*, which are illustrated in FIGS. 7B1 to 7B4, FIGS. 7C1 to 7C3, FIGS. 7D1 to 7D3, FIGS. 7E1 to 7E2 and FIGS. 7F1 to 7F2, the ridge portion 12*a* abuts from the side part on the coating material 30 which has adhered to the downstream face 11 in the coating-film forming direction, due to the rotation of the cleaning member 12, and scrapes off the coating material 30. This state is schematically illustrated in FIG. 8B. Thus, the coating material 30 becomes easy to be stripped from the downstream face 11 in the coating-film forming direction, and the downstream face 11 in the coating-film forming direction can be more efficiently cleaned.

An outer diameter d of the cleaning member 12, specifically, the diameter of the rotation locus circle needs to be larger than the diameter of the center hole 2 of the circular coating head 1. This is because when the outer diameter d of the cleaning member 12 is larger than the diameter of the center hole 2 of the circular coating head 1, the cleaning member 12 thereby comes in contact with the inner wall 3 of the center hole 2 and the downstream face 11 in the coating-film forming direction, and can clean the inner wall and the downstream face. The outer diameter d of the cleaning member 12 can be particularly in a range of 1.05 or more times and 1.25 or less times of the diameter of the center hole 2 of the circular coating head 1. When the outer diameter d is controlled to this range, the cleaning member 12 can thereby clean the inner wall and the downstream face uniformly in a peripheral direction which regards the center hole 2 of the circular coating head 1 as the center, and without applying a large load to the cleaning member 12 and the lower holding shaft 25 which holds the cleaning member 12.

The thickness t of the cleaning member 12 can be 0.5 mm or more and 3.0 mm or less. When the thickness t of the cleaning member 12 is controlled to this range, the cleaning member 12 can thereby clean the inner wall and the downstream face without applying a large load to the lower holding shaft 25 and the circular coating head 1, and a restoring force that the cleaning member 12 intends to return the flexure to the original state becomes sufficiently strong. Accordingly, the cleaning member 12 can efficiently scrape off the coating material. However, the shape and the dimension of the cleaning member 12 can be appropriately set according to the shape of the downstream face 11 in the coating-film forming direction of the circular coating head 1 and the diameter of the center hole 2.

The number of the cleaning member 12 which is mounted on the lower holding shaft 25 may be any number as long as the number is one or more.

The number of revolutions of the cleaning member 12 when the downstream face 11 in the coating-film forming direction is cleaned can be arbitrarily set. However, the number of revolutions can be further set at a speed of such a degree that the cleaning member 12 rotates at least one time with respect to the circular coating head 1 in a state in which the cleaning member 12 contacts the downstream face 11 in the coating-film forming direction. When the number of revolutions is set in this way, the downstream face 11 in the coating-film forming direction can be thereby cleaned uniformly in the peripheral direction of the center hole 2 of the circular coating head 1.

As for the material of the cleaning member 12, urethane rubber, butyl rubber, fluorine rubber and silicone rubber can be used, for instance.

The cleaning member 12 can have a Shore A hardness of 70 or more. When the Shore A hardness is 70 or more, when the cleaning member 12 cleans the downstream face 11 of the circular coating head 1 in the coating-film forming direction while bending, a restoring force of returning the flexure to the original state sufficiently strongly works. Because of this, the cleaning member 12 and the downstream face 11 of the circular coating head 1 in the coating-film forming direction rub against each other more strongly, and the coating material 30 can be more efficiently scraped off.

When the downstream face 11 in the coating-film forming direction, which is a surface to be cleaned, has the taper shape as previously described, the rubbing time period becomes long when the cleaning member 12 is cleaned, and accordingly the coating material can be more efficiently scraped off.

The moving speed of the LM guides 22 and 23 and a flow rate of the coating material to be ejected may be arbitrarily set, but the present invention is particularly effective when the moving speed of the LM guides 22 and 23 is fast and the flow rate of the coating material to be ejected is large. Incidentally, the relative moving direction (coating-film forming direction) between the circular coating head 1 and mandrel 31 is not limited to the vertical direction, but may be arbitrarily set. In addition, as for a method of relative movement, not the mandrel 31 but the circular coating head 1 may be structured to move.

The coating material 30 which is coated on the outer peripheral surface of the mandrel 31 in the present embodiment is cured by heat treatment or the like in a post process, and a coating film is thereby formed. At this time, the coating material 30 can be heated in a non-contact way in order to be crosslinked while keeping the shape of the coating film. Specifically, the heating method can include infrared heating, hot air heating and nichrome heating. The infrared heating, in particular, can be employed which uses a simple apparatus and can heat the coating film uniformly in the shaft direction.

At this time, if an infrared heating lamp or the like is fixed and the mandrel 31 having the coating film provided thereon is rotated in the peripheral direction with the mandrel 31 working as a rotary shaft, the coating film can be heated uniformly also in the peripheral direction. The heating temperature of the coating film depends on the material of the coating material 30, but can be 100° C. to 250° C. at which the curing reaction of the coating material 30 starts. For instance, when the infrared heating is performed, a distance between an infrared heating apparatus and the coating film, and the output of an infrared heating unit (infrared heater or the like) may be adjusted according to characteristics (thermal conductivity, specific heat and the like) of the coating material 30. In addition, when the hot air heating is performed, the temperature, the direction and the air speed of the hot air may be adjusted. In order to stabilize the physical properties of the cured coating film, and to remove the reaction residue and the unreacted low molecules in the coating film, the coating film after having been heated may be further subjected to reheating treatment (secondary curing).

The thickness of the coating film can be controlled to a range of 0.4 mm or more and 10.0 mm or less. For instance, in a developing roller which is used in an electrophotographic type of image forming apparatus, the thickness of the coating film is 0.4 mm or more in many cases. This is because the developing roller needs to keep a stable contact state because of rotating in a state of being brought into contact with other members, and when the thickness of the coating film is controlled to 0.4 mm or more, the coating film can sufficiently exhibit its elasticity and can stably keep the contact state with other members. In addition, when the thickness of the coating film is controlled to 10.0 mm or less, the coating material after having been coated does not drip, and accordingly the elastic roller having a high dimensional accuracy can be obtained.

Examples of the coating material 30 which is used for the coating film can include liquid diene rubber (butadiene rubber, isoprene rubber, acrylonitrile butadiene rubber, chloroprene rubber and ethylene propylene rubber), liquid silicone rubber and liquid urethane rubber. These materials can be used solely or in combination with other plurality of types. Furthermore, foams of these materials may also be used. It is important for the coating film to have an appropriately low hardness and a sufficient resilience from deformation, and accordingly, among the rubbers, the liquid silicone rubber and the liquid urethane rubber can be used.

Addition type liquid silicone rubber, in particular, can further be employed which has such characteristics that formability is adequate, the stability of a dimensional accuracy is high and a reaction by-product is not produced during a curing reaction. When the electroconductivity needs to be imparted to the elastic roller, an electroconductive agent may be blended and dispersed in these coating materials. In addition, in the coating with the use of the circular coating head 1, the viscosity of the coating material such as the addition type liquid silicone rubber can be 5,000 Pa-s or more and 20,000 Pa-s or less.

When the viscosity of the coating material is in this range, the coating material can be prevented from dripping in a gravity direction due to its own weight, and the accuracy of the outer dimension and the circumference vibration can be adequately controlled. In addition, it can prevent a problem in which a high load is applied to the apparatus due to high viscosity of the coating material, which is associated with a shear rate in the pipe at the time when the material is supplied, so that the stable material supply may become difficult.

The material of the mandrel 31 of the elastic roller, which is coated with the previously described coating material 30, may be any material as long as the material is electroconductive, and can be appropriately selected and be used from carbon steel, alloy steel, cast iron and an electroconductive resin. The alloy steel can include stainless steel, nickel chromium steel, nickel chromium molybdenum steel, chromium steel, chromium molybdenum steel, and steel for nitriding to which Al, Cr, Mo and V are added. A mandrel made from metal, in particular, can be used from the viewpoint of strength. The mandrel 31 may be hollow or solid. The outer diameter of the mandrel 31 is usually approximately 4 to 20 mm.

The elastic roller which has been manufactured based on the present invention can be used as a developing roller, a charging roller, a transfer roller, a fixing roller and the like in the electrophotographic image forming apparatus. In addition, a covering layer may be provided on the elastic layer, as needed.

According to the present invention, the elastic roller in which the streak on the surface of the coating film is hardly generated can be manufactured, even when a plurality of elastic rollers is manufactured with the use of the circular coating head.

EXEMPLARY EMBODIMENT

More detailed exemplary embodiments of the present invention will be described below. Firstly, an evaluation method and a method for preparing a coating liquid in the exemplary embodiments will be described below.

[Evaluation Method]

In the following exemplary embodiments, the coating films were continuously formed on 50 mandrels, respectively, by the coating apparatus illustrated in FIG. 6 on the same condition. Then, the formed coating films were visually observed, the presence or absence of the streak of the convex shape was checked, and the number of the elastic rollers was counted which had the streak of the convex shape formed thereon. The results were evaluated in the following way.

A: There was no elastic roller which had the streak of the convex shape formed thereon, in the 50 mandrels.

B: There were 1 to 5 elastic rollers which had the streak of the convex shape formed thereon, in the 50 mandrels.

C: There were 6 to 10 elastic rollers which had the streak of the convex shape formed thereon, in the 50 mandrels.

D: There were 11 to 20 elastic rollers which had the streak of the convex shape formed thereon, in the 50 mandrels.

E: There were 21 to 30 elastic rollers which had the streak of the convex shape formed thereon, in the 50 mandrels.

F: There were 31 to 40 elastic rollers which had the streak of the convex shape formed thereon, in the 50 mandrels.

G: There were 41 to 50 elastic rollers which had the streak of the convex shape formed thereon, in the 50 mandrels.

For the elastic roller on which the streak of the convex shape was visually confirmed, the height of the streak of the convex shape was evaluated. Specifically, the portion on the elastic roller, in which the streak of the convex shape was confirmed was measured with the use of a laser displacement sensor (trade name: LT-9500V, made by Keyence Corporation), and thereby a height between the basal part and the peak of the streak of the convex shape was determined. The heights were similarly determined on the group of the elastic rollers on which the streaks of the convex shapes were formed, and the maximum value of the heights in the group of the elastic rollers was determined as the height of the streak. The results were evaluated in the following way.

A: The height of the streak of the convex shape was smaller than 10 μm.

B: The height of the streak of the convex shape was 10 μm or larger and smaller than 15 μm.

C: The height of the streak of the convex shape was 15 μm or larger and smaller than 30 μm.

D: The height of the streak of the convex shape was 30 μm or larger.

[Preparation of Silicone Rubber Composition]

The material for the coating film to be coated on the mandrel in the following exemplary embodiments was prepared in the following way.

Dimethylpolysiloxane (with molecular weight Mw of 40,000, made by Momentive Performance Materials Japan LLC) which has a vinyl group each in both terminals of the molecular chain, and carbon black (trade name: Raven 890, made by Columbian Chemical) were prepared. Then, 100 parts by mass of dimethylpolysiloxane and 10 parts by mass of carbon black were mixed and defoamed for 30 minutes with the use of a planetary mixer, and a silicone rubber base material was obtained.

Furthermore, 0.02 parts by mass of an isopropyl alcohol solution of chloroplatinic acid (3 mass % of platinum content) were added to and mixed with to 100 parts by mass of the base material, and a coating material A-1 was obtained. In addition, 1.5 parts by mass of organohydrogen polysiloxane (1 mass % of SiH content) having a viscosity of 10 cps were added to and mixed with 100 parts by mass of the base material, and a coating material A-2 was obtained. The coating material A-1 and A-2 were set in a raw-material tank 1 and tank 2, respectively, and were sent out to a static mixer with the use of a pressure pump, and were mixed at a volume ratio of 1:1. This mixed liquid was determined as a coating material A. The viscosity of the coating material A was 10,000 (Pa-s), which was measured immediately after having been mixed. Incidentally, these compositions were prepared under the environment in which a temperature was 23° C. and a relative humidity was 50%.

Exemplary Embodiment 1

A workpiece was employed as the mandrel 31, which was an aluminum element pipe that had an outer diameter of 10 mm and a length of a pipe portion of 240 mm and that was coated with a primer (trade name: DY39-051, made by Dow Corning Toray Co., Ltd.), and this mandrel 31 was coated with the coating material by the coating apparatus illustrated in FIG. 6. FIGS. 9A to 9H schematically illustrate a sequence of flows of coating and cleaning in the present exemplary embodiment.

As for the coating apparatus which was used in the present exemplary embodiments, the diameter of the center hole 2 of the circular coating head 1 was 11.4 mm, the width of the circular slit 4 was 1.0 mm, the height of the inner wall 3 was 1.0 mm, and the taper angle θ of the downside face 11 in the coating-film forming direction was 45 degrees. The cleaning member 12 and the disk member 28 were attached to the lower holding shaft 25 of this coating apparatus. The disk member 28 was attached to 3 mm above the cleaning member 12. The cleaning member 12 was flexible and had a disc shape with an outer diameter d of 12 mm and a thickness t of 1 mm, as illustrated in FIGS. 7A1 and 7A2. The material of the cleaning member 12 was ester urethane rubber, and had a Shore A hardness of 70. The disk member 28 also had a disk shape with the outer diameter d of 12 mm and the thickness t of 1 mm, was formed from ester urethane rubber, and had a Shore A hardness of 70.

Figure 9A:
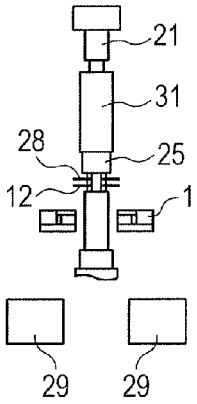
FIG. 9A is a schematic sectional view (1) for describing a process for manufacturing the elastic roller of the present invention.
Figure 9B:
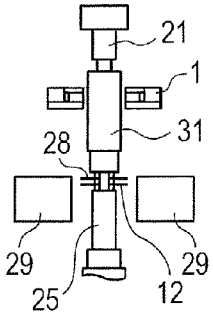
FIG. 9B is a schematic sectional view (2) for describing the process for manufacturing the elastic roller of the present invention.

At the time of coating, firstly, the LM guide 22 illustrated in FIG. 6 was moved to the upper end, and the upper holding shaft 21 was moved upward by an unillustrated cylinder beforehand, as illustrated in FIG. 9A. Then, the lower end of the mandrel 31 was held by the lower holding shaft 25, then the upper holding shaft 21 was moved down by an unillustrated cylinder, and the upper holding shaft 21 and the lower holding shaft 25 sandwiched and fixed the mandrel 31. After that, the LM guides 22 and 23 were moved down to position the mandrel 31 at a coating start position, as illustrated in FIG. 9B.

Figure 9C:
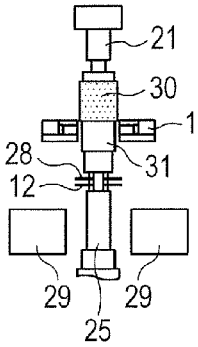
FIG. 9C is a schematic sectional view (3) for describing the process for manufacturing the elastic roller of the present invention.

Then, the LM guides 22 and 23 were moved up at 60 mm/sec while the coating material 30 was ejected toward the outer peripheral surface of the mandrel 31 which was positioned in the inner part of the center hole 2, from the circular slit 4 of the circular coating head 1, at a fixed flow rate of 1,140 $mm^3$/sec. Thus, the outer peripheral surface of the mandrel 31 was sequentially coated with the coating film, as illustrated in FIG. 9C. Finally, the coating film which had a length of 239 mm and a thickness of 0.5 mm was formed on the outer peripheral surface of the mandrel 31. When the mandrel 31 was coated from a coating start position to a coating end position, the ejection of the coating material 30 from the circular slit 4 was stopped.

Figure 9D:
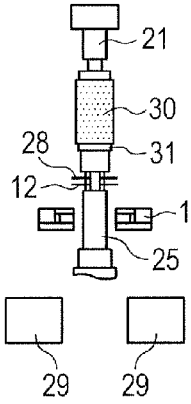
FIG. 9D is a schematic sectional view (4) for describing the process for manufacturing the elastic roller of the present invention.

The LM guides 22 and 23 were further moved upward to position the cleaning member 12 above the circular coating head 1, as illustrated in FIG. 9D. At this time, as in the state illustrated in FIG. 4B, the coating material 30 was stretched to both sides of the circular slit 4 of the circular coating head 1 and the mandrel 31; and adhered to the inner wall 3 of the center hole 2 and the periphery of the circular slit 4 of the circular coating head 1, and to the downstream face 11 in the coating-film forming direction. In addition, when the disk member 28 passed upward in the center hole 2 of the circular coating head 1, the coating material 30 which had adhered to the inner wall 3 of the center hole 2 of the circular coating head 1 was cleaned by the disk member 28.

Figure 9E:
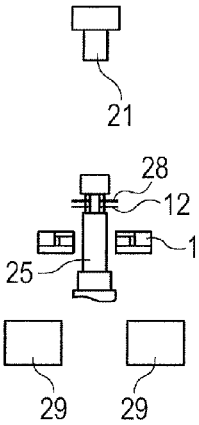
FIG. 9E is a schematic sectional view (5) for describing the process for manufacturing the elastic roller of the present invention.

Then, as illustrated in FIG. 9E, the upper holding shaft 21 was moved up by an unillustrated cylinder, and the mandrel 31 having the coating film formed thereon was taken out from the coating apparatus by an unillustrated attaching/detaching mechanism. The mandrel 31 which was taken out from the coating apparatus and had the coating film thereon was heated by an unillustrated infrared heating apparatus or the like and cured, thus the elastic roller was obtained. Specifically, in the infrared heating apparatus, the mandrel 31 having the coating film thereon was vertically erected, and was rotated at 60 rpm; meanwhile, the surface of the coating film was irradiated with infrared rays (output of 1,000 W) emitted from an infrared heating lamp (trade name: HYL 25, made by Hybec Corporation) for 1 minute, thus the coating film was cured. Incidentally, a space between the surface of the coating film and the infrared lamp was 60 mm, and the surface temperature of the coating film was 180° C. This surface temperature of the coating film was measured with a digital radiation temperature sensor (trade name: FT-H20, made by Keyence Corporation).

Figure 9F:
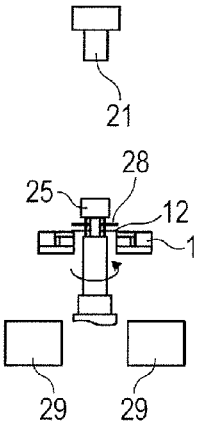
FIG. 9F is a schematic sectional view (6) for describing the process for manufacturing the elastic roller of the present invention.

On the other hand, the LM guides 22 and 23 were moved down at 300 mm/sec, and were moved to a position right before the cleaning member 12 comes in contact with the downstream face 11 of the circular coating head 1 in the coating-film forming direction. While the LM guides 22 and 23 were moved down at 10 mm/sec from the position, as illustrated in FIG. 9F, the rotary drive source 26 which was connected to the lower holding shaft 25 was driven to rotate the lower holding shaft 25 through the rotation transmitting belt 27 at 200 rpm. Thereby, similarly to the states illustrated in FIGS. 2 and 8A, the rotating cleaning member 12 was made to rub the downstream face 11 in the coating-film forming direction to clean the downstream face 11 in the coating-film forming direction.

Figure 9G:
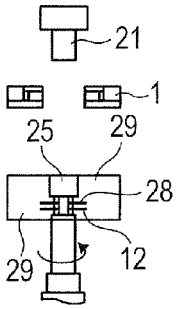
FIG. 9G is a schematic sectional view (7) for describing the process for manufacturing the elastic roller of the present invention.
Figure 9H:
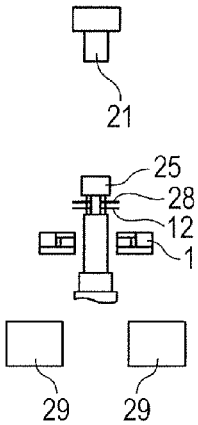
FIG. 9H is a schematic sectional view (8) for describing the process for manufacturing the elastic roller of the present invention.

When the rotation of the lower holding shaft 25 and the downward movement of the LM guides 22 and 23 were continued, the cleaning member 12 moved down along the downstream face 11 in the coating-film forming direction while being elastically deformed, and rubbed almost the whole surface of the downstream face 11 in the coating-film forming direction. After that, the cleaning member 12 was further shrunk by the elastic deformation, and entered into the center hole 2. When the cleaning member 12 had completely entered into the center hole 2, the rotary drive source 26 was stopped to stop the rotation of the lower holding shaft 25 which was connected with the rotation transmitting belt 27. Then, the LM guides 22 and 23 were moved down at 300 mm/sec again to move the lower holding shaft 25 down to a coating material recovery position below the circular coating head 1. After the downward movement of the lower holding shaft 21 had ended, the collection container 29 which had waited in a state of being opened so as not to interfere with the coating operation at the coating material recovery position was closed so as to surround the cleaning member 12 and the disk member 28. The lower holding shaft 25 was rotated for 2 seconds at 18,000 rpm, as illustrated in FIG. 9G. The centrifugal force generated by this rotation made the coating material 30 which had adhered to the cleaning member 12 and the disk member 28 scatter in the collection container 29, and adhere to the inner wall face of the collection container 29, thus the coating material 30 was collected. Then, the rotary drive source 26 was stopped to stop the rotation of the lower holding shaft 25 which was connected with the rotation transmitting belt 27. Finally, as illustrated in FIG. 9H, in order to prepare for the next coating step, the collection container 29 was opened, the LM guides 22 and 23 were moved up at 300 mm/sec, and the cleaning member 12 was positioned above the circular coating head 1. Thus, the coating apparatus waited until the next uncoated mandrel 31 was conveyed by an unillustrated attaching/detaching mechanism. After a sequence of these steps had ended, the coating material did not adhere to the downstream face 11 of the circular coating head 1 in the coating-film forming direction, and accordingly when the next mandrel 31 was coated, the elastic roller could be manufactured which did not have the streak of the convex shape thereon.

After that, the above described operations illustrated in FIGS. 9A to 9H were repeatedly performed, and the 50 mandrels 31 in total were coated. Then, the coated mandrels were evaluated according to the above described evaluation method. The result is shown in Table 1.

TABLE 1

| | Circular coating head | | Cleaning member | | | Rotation | | Evaluation | |
|---|---|---|---|---|---|---|---|---|---|
| | Center hole Diameter [mm] | Taper angle [°] | Shape | Outer diameter [mm] | Shore A hardness | Number of revolutions [rpm] | Moving down speed during rotation [mm/s] | Number of rollers having caused streak | Height of streak |
| Exemplary Embodiment 1 | 11.4 | 45 | FIG. 7A1 | 12.0 | 70 | 200 | 10 | B | A |
| Exemplary Embodiment 2 | 11.4 | 45 | FIG. 7A1 | 12.0 | 30 | 200 | 10 | C | A |
| Exemplary Embodiment 3 | 11.4 | 45 | FIG. 7A1 | 12.0 | 90 | 200 | 10 | B | A |
| Exemplary Embodiment 4 | 11.4 | 45 | FIG. 7A1 | 11.6 | 70 | 200 | 10 | C | A |
| Exemplary Embodiment 5 | 11.4 | 45 | FIG. 7A1 | 14.0 | 70 | 200 | 10 | B | A |
| Exemplary Embodiment 6 | 11.4 | 45 | FIG. 7A1 | 15.0 | 70 | 200 | 10 | C | A |
| Exemplary Embodiment 7 | 11.4 | 45 | FIG. 7B1 | 12.0 | 70 | 200 | 10 | A | — |
| Exemplary Embodiment 8 | 11.4 | 45 | FIG. 7C1 | 12.0 | 70 | 200 | 10 | A | — |
| Exemplary Embodiment 9 | 11.4 | 45 | FIG. 7D1 | 12.0 | 70 | 200 | 10 | A | — |

TABLE 1-continued

| | Circular coating head | | Cleaning member | | | Rotation | | Evaluation | |
|---|---|---|---|---|---|---|---|---|---|
| | Center hole Diameter [mm] | Taper angle [°] | Shape | Outer diameter [mm] | Shore A hardness | Number of revolutions [rpm] | Moving down speed during rotation [mm/s] | Number of rollers having caused streak | Height of streak |
| Exemplary Embodiment 10 | 11.4 | 45 | FIG. 7E1 | 12.0 | 70 | 200 | 10 | B | A |
| Exemplary Embodiment 11 | 11.4 | 45 | FIG. 7F1 | 12.0 | 70 | 200 | 10 | B | A |
| Exemplary Embodiment 12 | 11.4 | 45 | FIG. 7A1 | 12.0 | 70 | 100 | 10 | B | A |
| Exemplary Embodiment 13 | 11.4 | 45 | FIG. 7A1 | 12.0 | 70 | 50 | 10 | C | A |
| Exemplary Embodiment 14 | 11.4 | 45 | FIG. 7A1 | 12.0 | 70 | 1000 | 10 | A | — |
| Exemplary Embodiment 15 | 11.4 | 45 | FIG. 7A1 | 12.0 | 70 | 200 | 1 | A | — |
| Exemplary Embodiment 16 | 11.4 | 45 | FIG. 7A1 | 12.0 | 70 | 200 | 20 | B | A |
| Exemplary Embodiment 17 | 11.4 | 45 | FIG. 7A1 | 12.0 | 70 | 200 | 40 | C | A |
| Exemplary Embodiment 18 | 11.4 | — | FIG. 7A1 | 12.0 | 70 | 200 | 10 | C | A |
| Exemplary Embodiment 19 | 11.4 | 30 | FIG. 7A1 | 12.0 | 70 | 200 | 10 | B | A |
| Exemplary Embodiment 20 | 11.4 | 65 | FIG. 7A1 | 12.0 | 70 | 200 | 10 | B | A |
| Exemplary Embodiment 21 | 11.4 | 45 | FIG. 7A1 | 12.0 | 70 | 200 | 10 | A | — |
| Exemplary Embodiment 22 | 11.4 | 45 | FIG. 7A1 | 12.0 | 70 | 200 | 10 | B | A |
| Comparative Example 1 | 11.4 | 45 | FIG. 7A1 | 12.0 | 70 | No rotation | — | F | B |
| Comparative Example 2 | 11.4 | 45 | FIG. 7B1 | 12.0 | 70 | No rotation | — | F | B |
| Comparative Example 3 | 11.4 | 45 | FIG. 7A1 | 11.1 | 70 | 200 | 10 | G | C |
| Comparative Example 4 | 11.4 | 45 | FIG. 7A1 | 11.4 | 70 | 200 | 10 | G | C |

Exemplary Embodiments 2 to 20

Substantially the same coating step and cleaning step as in Exemplary Embodiment 1 were performed while various conditions were changed. Specifically, the shape of the circular coating head 1, the taper angle θ of the downstream face 11 in the coating-film forming direction, the shape, the outer diameter d, the Shore A hardness and the number of the cleaning member 12, the number of revolutions of the cleaning member 12 in the cleaning step, and the moving down speed during rotation are changed as shown in Table 1. In each of the exemplary embodiments, 50 mandrels 31 were continuously coated with the coating material on the same condition, and the coated mandrels 31 were evaluated. The results are shown in Table 1.

Exemplary Embodiment 21

Substantially the same coating step and cleaning step as in Exemplary Embodiment 1 were performed on changed conditions. The shape of the circular coating head 1, the taper angle θ of the downstream face 11 in the coating-film forming direction, the shape, the outer diameter d, the Shore A hardness and the number of the cleaning member 12, the number of revolutions of the cleaning member 12 in the cleaning step, and the moving down speed during rotation are changed as shown in Table 1. Furthermore, in the present exemplary embodiment, the coating speed was set at 30 mm/sec and the flow rate of the coating material 30 to be ejected was set at 570 $mm^3$/sec; and the coating film which had a length of 239 mm and a thickness of 0.5 mm was formed on the outer peripheral surface of the mandrel 31. On this condition, 50 mandrels 31 were continuously coated with the coating material, and the coated mandrels 31 were evaluated. The result is shown in Table 1.

Exemplary Embodiment 22

Substantially the same coating step and cleaning step as in Exemplary Embodiment 1 were performed on changed conditions. The shape of the circular coating head 1, the taper angle θ of the downstream face 11 in the coating-film forming direction, the shape, the outer diameter d, the Shore A hardness and the number of the cleaning member 12, the number of revolutions of the cleaning member 12 in the cleaning step, and the moving down speed during rotation are changed as shown in Table 1. Furthermore, in the present exemplary embodiment, the coating speed was set at 120 mm/sec and the flow rate of the coating material 30 to be ejected was set at 2,280 $mm^3$/sec; and the coating film which had the length of 239 mm and the thickness of 0.5 mm was formed on the outer peripheral surface of the mandrel 31. On this condition, 50 mandrels 31 were continuously coated with the coating material, and the coated mandrels 31 were evaluated. The result is shown in Table 1.

Comparative Examples 1 to 4

Comparative Examples 1 to 4 were performed which were to be compared with each of the exemplary embodiments of the present invention.

In Comparative Examples 1 to 2, the cleaning member 12 was not rotated when the cleaning member 12 cleans the downstream face 11 in the coating-film forming direction. In addition, in Comparative Examples 3 and 4, the cleaning member 12 was used which has an outer diameter not larger than the diameter of the center hole 2 of the circular coating head 1. In other points, substantially the same coating step and cleaning step as in Exemplary Embodiment 1 were performed. The following conditions were shown in Table 1: the shape and the taper angle θ of the downstream face 11 in the coating-film forming direction, of the circular coating head 1; the shape, the outer diameter d, the Shore A hardness and the number of the cleaning member 12; and the number of revolutions and the moving down speed during rotation, in the cleaning step of the cleaning member 12. In each of the comparative examples, 50 mandrels 31 were continuously coated on the same condition, and the coated mandrels 31 were evaluated. The results are shown in Table 1.

[Evaluation Result]

As shown in Table 1, in each of Exemplary Embodiments 1 to 22 of the present invention, an adequate result was obtained such that the coating material 30 little adhered to the downstream face 11 in the coating-film forming direction and had few streaks of the convex shape formed thereon.

In contrast to this, in Comparative Examples 1 to 4, many elastic rollers had the streaks formed thereon, and the heights of the streaks were comparatively high. In Comparative Examples 1 and 2, the cleaning member 12 cleaned the downstream face 11 in the coating-film forming direction without being rotated, and accordingly it is considered that a portion was formed on which the cleaning member 12 cannot strongly rub the downstream face 11 in the coating-film forming direction, depending on the elastically deformed state of the cleaning member 12. In addition, in Comparative Examples 3 and 4, the cleaning member 12 was too small, and accordingly it is considered that in the downstream face 11 in the coating-film forming direction, a portion was formed on which the cleaning member 12 did not contact the downstream face 11 in the coating-film forming direction. Accordingly, it is thought that any of Comparative Examples 1 to 4 could not sufficiently scrape off the coating material 30 which adhered to the downstream face 11 in the coating-film forming direction, and formed the streak of the convex shape in a practically problematic level.

Thus, according to the Exemplary Embodiments 1 to 22 of the present invention, the coating material 30 which adhered to the downstream face 11 in the coating-film forming direction could be sufficiently scraped off, and the streak of the convex shape in a practically problematic level did not occur, compared to Comparative Examples 1 to 4.

However, in Exemplary Embodiment 2, the Shore A hardness of the cleaning member 12 was low and a restoring force of returning the flexure of the cleaning member 12 to the original state was weak, and accordingly the number of the formed streaks was evaluated as the rank C. In Exemplary Embodiments 4 and 6, the outer diameter d of the cleaning member 12 was 1.05 or less times or 1.25 or more times of the diameter of the center hole 2 of the circular coating head 1, and accordingly the unevenness in the peripheral direction occurred when the downstream face 11 in the coating-film forming direction was cleaned, and the number of the formed streaks was evaluated as the rank C. In Exemplary Embodiment 18, the downstream face 11 in the coating-film forming direction did not have the taper shape, and accordingly the time period was short during which the cleaning member 12 rubbed the downstream face 11 in the coating-film forming direction. Accordingly, the number of the formed streaks was evaluated as the rank C.

On the other hand, as illustrated in FIGS. 7B1 to 7F2, in Exemplary Embodiments 7 to 11 in which the cleaning member 12 having the ridge portion 12*a* was used, the downstream face 11 in the coating-film forming direction was more efficiently cleaned. In Exemplary Embodiments 7 to 9, in particular, in which the cleaning members 12 illustrated in FIGS. 7B1 to 7D3 were used, the streak did not occur.

In Exemplary Embodiments 14 and 15, the number of revolutions was particularly large in which the cleaning member 12 rotated with respect to the circular coating head 1 in a state of contacting the downstream face 11 in the coating-film forming direction, the streak did not occur.

In addition, in Exemplary Embodiment 21, the coating speed was slow and the surface of the coating film during coating did not reach the downstream side in the coating-film forming direction so much, and accordingly the streak did not occur.

From these results, it can be said that in the present invention, the Shore A hardness of the cleaning member 12 can be comparatively high, for instance, 70 or more, and the outer diameter d of the cleaning member 12 can be approximately 1.05 to 1.25 times of the diameter of the center hole 2 of the circular coating head 1.

In addition, it can be said that the downstream face 11 in the coating-film forming direction can further have the taper shape, and the cleaning member 12 can further have the ridge portion 12*a* as illustrated in FIGS. 7B1 to 7F2. Furthermore, it is effective for preventing the formation of the streak of the convex shape that the number of revolutions is large in which the cleaning member 12 rotates with respect to the circular coating head 1 in a state of contacting the downstream face 11 in the coating-film forming direction, or the coating speed is comparatively slow. However, the present invention is not limited to these constitutions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-200947, filed Sep. 30, 2014, which is hereby incorporated by reference herein in its entirety.

What is claimed is:

1. A process for manufacturing an elastic roller, the elastic roller having a mandrel and a coating film on an outer peripheral surface thereof, the process comprising:

a first step of forming a coating film of a coating material on an outer peripheral surface of a first mandrel by a circular coating head; and a second step of forming a coating film of the coating material on an outer peripheral surface of a second mandrel by the circular coating head, the circular coating head having:

a center hole, a circular slit in an inner wall of the center hole, the circular slit being opened to a whole inner perimeter of the center hole, and a taper-shaped portion having an inclined surface at which a diameter is decreasing toward the center hole, the first step including:

arranging the first mandrel approximately coaxially with a central axis of the circular coating head; and forming the coating film of the coating material on the outer peripheral surface of the first mandrel by relatively moving the circular coating head and the first mandrel so that the inclined surface of the coating head is positioned in a downstream side, while ejecting the coating material from the circular slit; and the second step including:

arranging the second mandrel approximately coaxially with the central axis of the circular coating head; and forming the coating film of the coating material on the outer peripheral surface of the second mandrel by relatively moving the circular coating head and the second mandrel so that the inclined surface of the coating head is positioned in the downstream side, while ejecting the coating material from the circular slit, wherein the process further comprises a cleaning step between the first step and the second step, the cleaning step comprising:

making a cleaning member arranged approximately coaxially with the central axis of the circular coating head, in the downstream side in a moving direction of the first mandrel with respect to the circular coating head in the first step, the cleaning member being rotatable around the central axis of the circular coating head regarded as an approximate rotation center, having a rotation locus circle whose diameter is larger than a diameter of the center hole of the circular coating head, and being elastically deformable;

making the cleaning member relatively approach the circular coating head;

bringing the cleaning member into contact with a surface to be cleaned of the circular coating head, which faces the cleaning member;

rotating the cleaning member while the surface to be cleaned, including at least a part of the inclined surface, is in contact with the cleaning member; and inserting the cleaning member into the center hole.

2. The process for manufacturing the elastic roller according to claim 1, wherein the cleaning member has a ridge portion which extends in a direction that intersects with a tangent line of the rotation locus circle of the cleaning member, in a portion at which the cleaning member comes in contact with the surface to be cleaned.

3. The process for manufacturing the elastic roller according to claim 1, wherein the cleaning member is rotated one or more times with respect to the circular coating head, while the cleaning member contacts the surface to be cleaned.

* * * * *